United States Patent [19]

Nakajima et al.

[11] 4,189,257

[45] Feb. 19, 1980

[54] SHELTERING APPARATUS FOR USE IN LONG WALL MINING

[75] Inventors: Shigeo Nakajima; Masao Tanaka; Ken Takahashi, all of Tokyo; Nobuo Kiyama; Takao Kanno, both of Yokohama, all of Japan

[73] Assignee: Taiheiyo Engineering Inc., Tokyo, Japan

[21] Appl. No.: 915,817

[22] Filed: Jun. 15, 1978

[30] Foreign Application Priority Data

Jul. 7, 1977 [JP] Japan ..... 52-81193

[51] Int. Cl.[2] ..... E21D 15/44

[52] U.S. Cl. ..... 405/291; 405/296

[58] Field of Search ..... 405/296, 292, 302, 291, 405/293, 294, 295; 299/31-33; 91/170 MP; 248/357

[56] References Cited

U.S. PATENT DOCUMENTS

| | | | |
|---|---|---|---|
| 3,702,061 | 11/1972 | Kuhn et al. | 405/296 |
| 3,848,420 | 11/1974 | Allen et al. | 405/293 |
| 3,916,631 | 11/1975 | Agnew et al. | 405/293 |
| 4,067,618 | 1/1978 | Nakajima et al. | 405/299 X |

*Primary Examiner*—Dennis L. Taylor

*Attorney, Agent, or Firm*—Thomas R. Morrison

[57] ABSTRACT

A sheltering apparatus for use in the long wall face of mine wherein a plurality of plates are arranged in overlapping manner between a self-advancing support and an adjacent plate, and hung from wires whose ends are fixed to the supports through springs, and an air curtain is fixed at the front open portion of the support, whereby floating dust and falling dusty materials can be repelled from entering the inner space of the supports.

12 Claims, 4 Drawing Figures

SHELTERING APPARATUS FOR USE IN LONG WALL MINING

BACKGROUND OF THE INVENTION

The present invention relates to a sheltering apparatus employed in the pit face of coal mine and, more particularly, to a sheltering apparatus attached to a self-advancing support particularly employed in the long-wall face of a coal mine and intended to repel floating dust and falling dusty materials from around the operators who operate inside the supports the ranging drum shearer and the self-advancing supports.

The mining method of long-wall type comprises causing the ranging drum shearer with its rotary blades to reciprocate on a rail arranged along the long-wall face and to shift toward the face according to the mining progress. The self-advancing supports have been also used to support the roof at the face. During the mining process air is blown from either side of the entry roadways into the face to clear the air of floating dust or the like. Considering their health and security, it is desirable for the operators to watch and operate the shearer and the supports always from the windward. However, the operators can not always keep themselves protected from floating dust and falling dusty materials due to the functional limitation of the shearer and the consideration of mining efficiency. When every support or every group of supports continuously arranged along the face so as to support the roof of the face is progressively shifted toward the face according to the travel of the shearer, it may happen that dust and dusty materials fall through between the supports, particularly when the roof of the face is inclined to fall.

SUMMARY OF THE INVENTION

It is therefore an object of the present invention to provide an apparatus for repelling floating dust and falling dusty materials from around the operators of the shearer and the self-advancing supports, the site laborers and others without causing any hindrance to the operation of the self-advancing supports and the shearer.

Another object of the present invention is to provide an apparatus which can be used as a sheltering passage and safety shelter between adjacent supports in case an emergency like the fall of the roof should occur.

These and other objects as well as the merits of the present invention will be apparent from the following detailed description with reference to the accompanying drawings.

DETAILED DESCRIPTION OF THE PREFERRED EMBODIMENT

Figure 1:
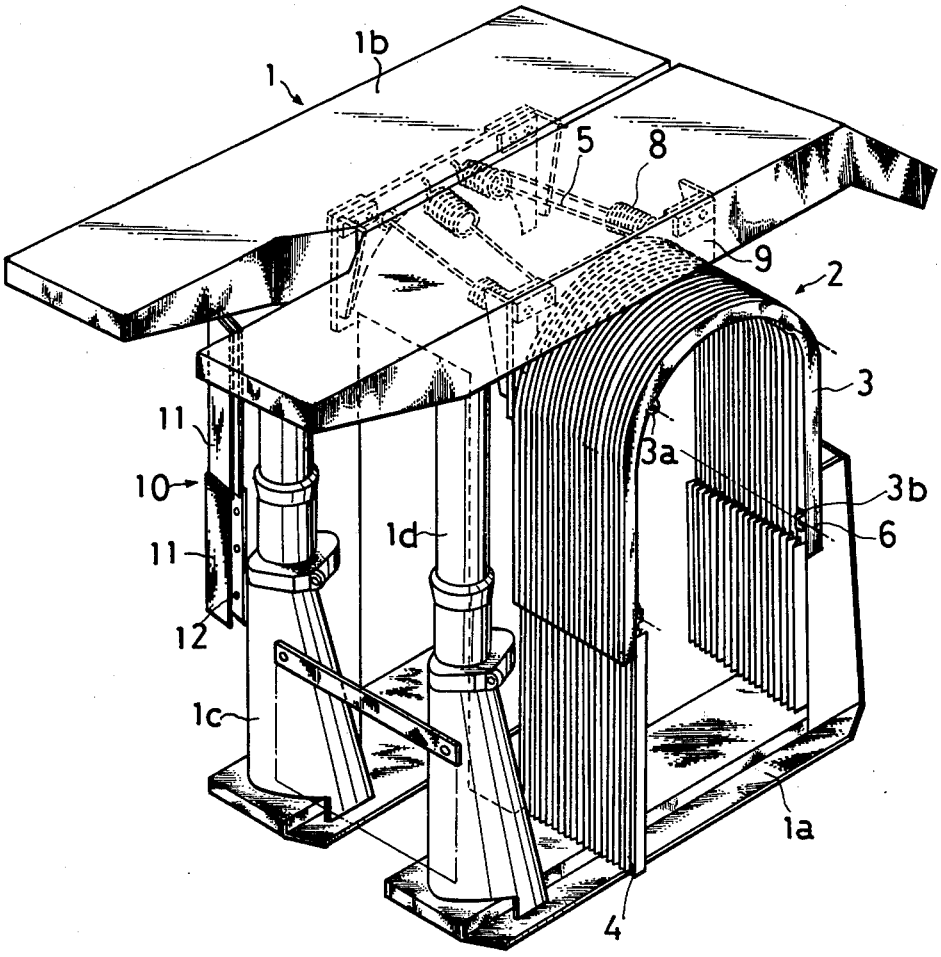
FIG. 1 is an isometric view showing an embodiment of the present invention.

FIG. 1 shows a self-advancing support which is viewed from its front side and provided with a sheltering apparatus of the present invention. The self-advancing support 1 composing with other groups of supports is arranged along the long wall face of an underground mine and intended to support the face roof. The shearer (not shown) is reciprocated by a drawing means such as a haulage chain of a conveyer, said conveyer being arranged along the face and in front of the supports and shifted toward the face by a shifter including hydraulic cylinders and others means which are arranged on the base frame of the support. While being reciprocated, the shearer cuts the face with its rotating cutting drums.

The self-advancing support 1 is provided with the above-described shifter, upper beams 1*b* for supporting the roof at the face plates (not shown) adapted to urge against the wall of coal bed and others. The lowering and lifting of the upper beams and the shifting of the support are attained by the shifter, a hydraulic means 1*c* and other hydraulic means (not shown). Every support or every group of supports positioned in front of the face portion whose cutting has been completed is rendered operative to move toward the face following the travel of the shearer. The operators keep themselves near the shearer, usually in the inner space of the support 1, watching and operating the shearer. Every support is different both in its level and position depending on the physical condition of the face roof. Therefore, it can not be avoided that a clearance is caused between a support and its adjacent one, through which dusty materials falling from the face roof and dust floating in the mine comes into the inner space of the support.

Numeral 2 represents a sheltering means arranged between a support and its adjacent one, said sheltering means comprising a plurality of horseshoe-shaped plates 3. These plates 3 having skirt portions 4 provided at both lower ends thereof are hung from wires 5, which are stretched between the support and its adjacent one through wire openings 3*a* of the plates 3. There is other construction of the plates and skirt, in which a lower part of the plates is contained in the skirt to arrange the height of the plates. Numeral 6 represents springs or wires, which are stretched through metal fittings 3*b* or through-holes provided in both lower portions of the plates 3, said springs or wires being intended to stop the jolting of the plates 3. Numerals 7 and 8 denote springs, each of which is fixed at one end thereof to a fitting plate 9 attached to the underside of the upper beam 1*b* and connected at the other end thereof to one end of the wire 5. Though this embodiment has both ends of the wire 5 connected to different springs, respectively, it may be arranged that only one end of the wire 5 is connected to the spring.

As shown in FIG. 1, each of the plates 3 is desirably formed semicircular at the upper portion thereof so as to repel dust and falling dusty materials being heaped on the plates 3. The plate 3 is made of a plastic or metal sheet having a certain width and thickness. It is most important how wide the plate 3 is because the plates 3 must be kept overlapped with one another without causing any clearance therebetween even when a support is shifted in the upper, lower, forward or backward direction relative to its adjacent one. The plates 3 can be reduced or increased in number depending on the distance between the support and its adjacent one. The outer upper portion of the sheltering means may be covered by a hood-shaped sheet of cloth, rubber or plastics, thus more effectively prevent dust from coming into the inner space of the supports.

The construction in which the plates 3 are overlapped with one another allows the sheltering means to flexibly follow any movement of the supports. In other words, when a support is shifted in horizontal direction, for example, in relation to its adjacent one, the plates 3 are caused to elastically slide, by the action of the springs 7 and 8 and the wires 5, from one another keeping themselves overlapped, so that no clearance is caused between the adjacent plates through which dust can come into the inner space of the support.

There will be described a means for preventing dust or the like not from coming into the inner space of the support 1 through the portions left open at the front and back sides of the support.

Figure 2:
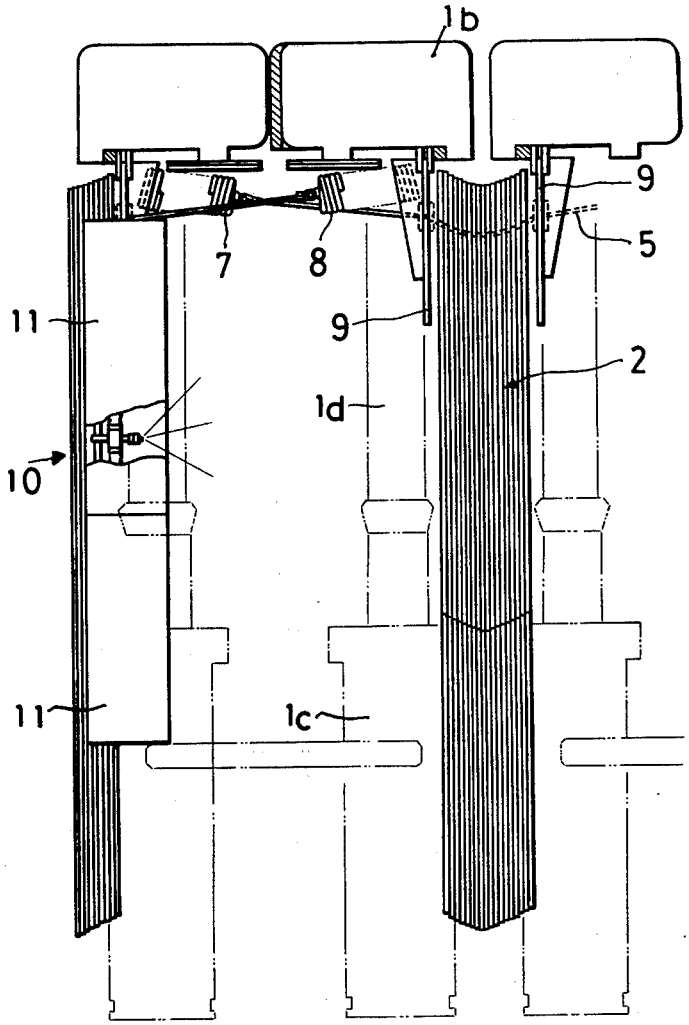
FIG. 2 is a front view of the embodiment.
Figure 3:
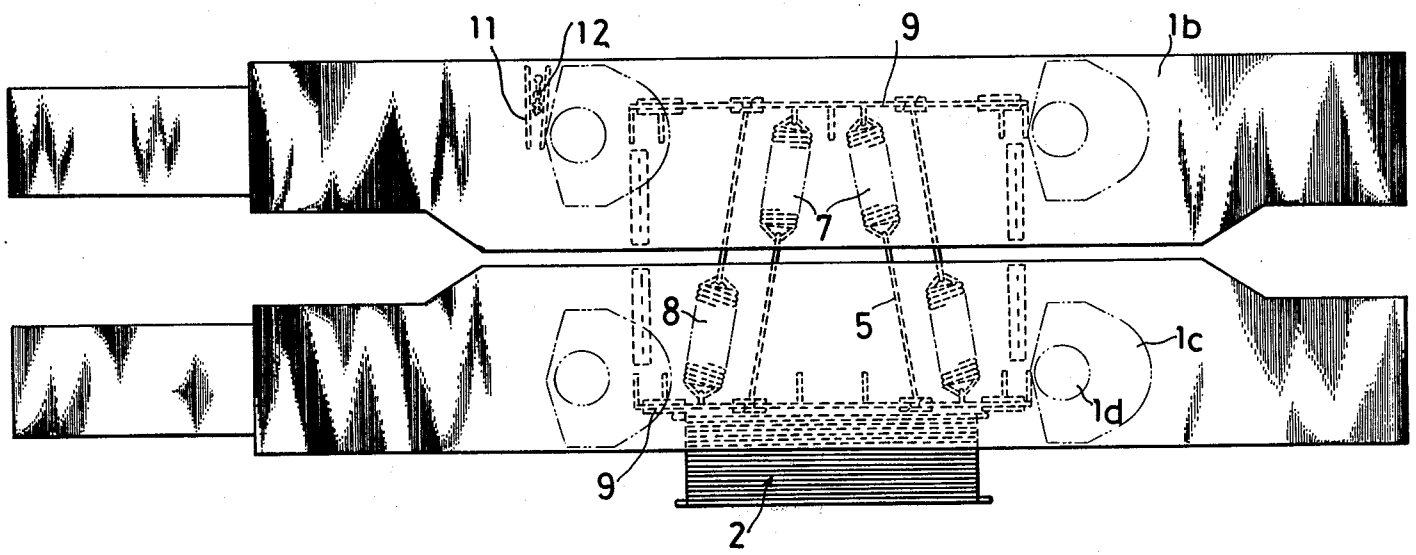
FIG. 3 is a plane view of the embodiment.
Figure 4:
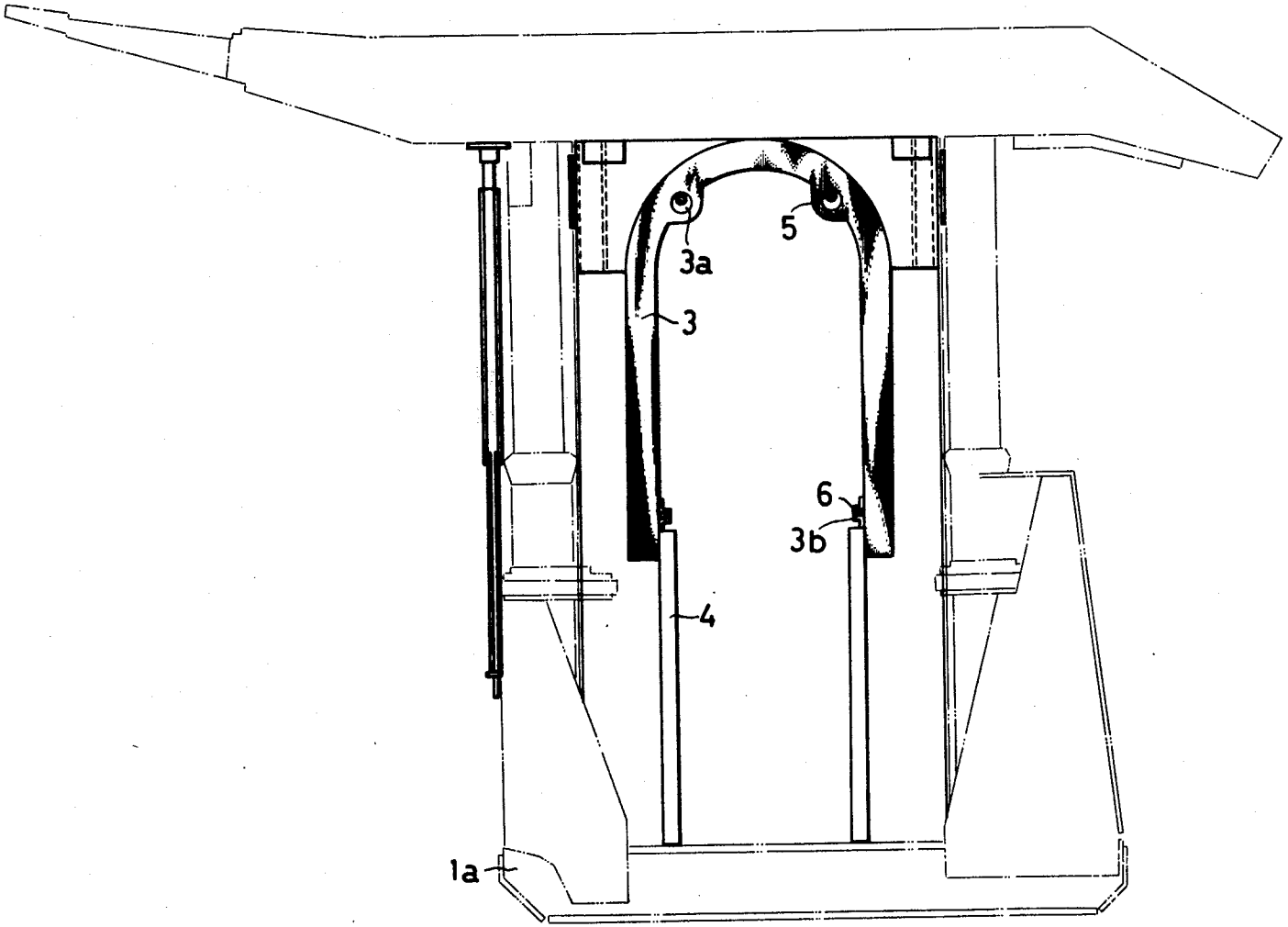
FIG. 4 is a side view of the embodiment.

In FIGS. 1 and 2, numeral 10 represents an air curtaining means intended to create a separative flow of free-air supplied by a compressor (not shown) and ejected through a plurality of nozzles 12 arranged inside the frames 11 which are fixed to the hydraulic means 1*c* and the rod 1*d*, thus repelling the dust containing air in the face site away from the inner space of the support 1.

As described above, the rod 1*d* is rendered operative by the action of hydraulic pressure to lift or lower the upper beam of the support. Therefore, the portion left open at the front side of the support is widened or narrowed according to the operation of the rod 1*d*. This makes it necessary to move the nozzles 12 corresponding to the change of the open portion so as to always cover with air flow the entire open portion. With the embodiment shown, the frame in which the nozzles 12 are arranged is divided into two parts, one of which is inserted into the other in telescopic relation, thus allowing the nozzles to eject air all over the open portion even if one of the parts is moved from or to the other. It may be arranged that a blast pipe having a plurality of nozzles provided and having such elasticity as the bellows have is fixed at both ends thereof to the upper beam 1*b* and the base frame 1*a* of the support so as to follow the movement of the rod 1*d*.

With the embodiment shown, the air curtaining means comprises arranging the air jetting nozzles 12 only along one side of the open portion. A suction means may be arranged opposite the air curtaining means and along the other side of the open portion so as to further enhance the effect of repelling dusty air and separating the air flow from the outside of the support. It is desirable in any case that the nozzles 12 are arranged at the intake side of each of the supports so as to enable the flow of air ejected through the nozzles 12 without disturbing major ventilation flow in the face.

There are arranged protecting plates around the circumference of the portion left open at the front side of the support in such a manner that falling dusty materials can be blocked but that persons such as the operators can freely pass. These protecting plates are desirably attached to the rod of the support in hinged manner for the convenience of the persons passing therethrough. It is also desirable to make the protecting plates of transparent material or to provide windows in the plates.

At the portion left open at the back side of the support is arranged another air curtaining means, a door of the accordion type or a door attached to the rod 1*d* in a hinged manner.

For the purpose of making the sheltering apparatus of the present invention more effective, an air flow having a little higher pressure than major ventilation air flow enforcedly ventilated into the face from the intake side of the face is pressurized into the inner space of the supports defined by the above described protecting and sheltering means. This air flow of higher pressure is generated by an air blaster arranged at the intake side of the face. However, the more it becomes remote from the air blaster, the more the pressure of air is lost. Therefore, air ejectors for the purpose of separation may be arranged along the supports, or air ejecting openings provided every support may be arranged along the line of supports enabling the dust containing air to be prevented from coming into the inner space of the supports by the air flow ejected through the air ejecting openings. The closing and opening of the air ejecting openings may be operated by the operator.

In the sheltering apparatus of the present invention described above, operators are protected from floating dust and falling dusty materials at the face of the mine. It also keeps the operators safe and relaxes them to the operation of the shearer and the supports, so that the coal mining efficiency can be further enhanced with substantial reduction of cost.

What is claimed is:

1. A sheltering apparatus for use in the long-wall face of mine wherein a plurality of plates are arranged in overlapped manner between a self-advancing support and its adjacent one, and hung from wires whose ends are fixed to the supports, said plurality of plates forming an inner space between said self-advancing supports whereby floating dust and falling dusty materials can be repelled from the inner space of the supports.

2. A sheltering apparatus of claim 1 wherein outer portion of the plates is covered by a hood-shaped sheet.

3. A sheltering apparatus of claim 1 wherein a skirt member is connected at the lower portion of the plates.

4. A sheltering apparatus of claim 3 wherein a lower part of the plates is contained in the skirt to arrange the height of the plates.

5. A sheltering apparatus of claim 1 wherein a spring is connected with at least one end of the wire to hang the plates.

6. A sheltering apparatus of claim 1 wherein an air curtaining means is fixed at the front open portion of the support to repel the outer air from flowing into the inner space of the self-advancing support.

7. A sheltering apparatus of claim 6 wherein an air curtaining means consists of air ejecting nozzles arranged along one side of the open portion.

8. A sheltering apparatus of claim 6 wherein an upper end of a frame or a blast pipe having ejecting nozzles is fixed to the bottom portion of the upper beam of the support to allow the nozzles to move according the movement of the upper beam.

9. In a mining apparatus of the type having a self-advancing support and at least one additional support spaced therefrom, at least one support wire between said self-advancing support and the adjacent additional support, a plurality of horseshoe-shaped overlapping plates suspended between said supports on said at least one support wire and substantially bridging the space between said supports whereby the entry of dust and dusty material into the space within said plates is substantially prevented.

10. The apparatus recited in claim 9 further comprising telescoping lower parts on the legs of each of said plates to arrange the height of said plates while excluding the entry of dust below said plates.

11. The apparatus recited in claim 9 further comprising at least one tension spring maintaining tension in said support wire.

12. The apparatus recited in claim 10 wherein said lower parts comprise first and second skirts on said legs.

* * * * *